US007997193B2

(12) United States Patent
Campioli et al.

(10) Patent No.: US 7,997,193 B2
(45) Date of Patent: Aug. 16, 2011

(54) PRINTING MACHINE AND DRYING DEVICE FOR CYLINDRICAL OBJECTS

(75) Inventors: Milo Campioli, Reggio Emilia (IT); Vittorio Ferrari, Reggio Emilia (IT)

(73) Assignee: Decomac-Societa' a Responsabilita' Limitata, Reggio Emilia (IT)

( * ) Notice: Subject to any disclaimer, the term of this patent is extended or adjusted under 35 U.S.C. 154(b) by 457 days.

(21) Appl. No.: 12/278,261

(22) PCT Filed: Jan. 25, 2007

(86) PCT No.: PCT/EP2007/050718

§ 371 (c)(1),
(2), (4) Date: Aug. 4, 2008

(87) PCT Pub. No.: WO2007/090744

PCT Pub. Date: Aug. 16, 2007

(65) Prior Publication Data

US 2009/0020024 A1 Jan. 22, 2009

(30) Foreign Application Priority Data

Feb. 10, 2006 (IT) ..... RE2006A0016

(51) Int. Cl.
*B41F 17/08* (2006.01)
*B41F 15/12* (2006.01)

(52) U.S. Cl. .... 101/38.1; 101/40.1; 101/126; 101/424.1

(58) Field of Classification Search ..... 101/38.1–40.1, 101/126, 424.1
See application file for complete search history.

(56) References Cited

U.S. PATENT DOCUMENTS

| | | | | |
|---|---|---|---|---|
| 6,337,487 | B1 * | 1/2002 | Dubuit et al. | 250/497.1 |
| 6,880,457 | B2 * | 4/2005 | Roesch et al. | 101/38.1 |
| 2005/0046648 | A1 * | 3/2005 | Dumenil | 347/2 |
| 2005/0087082 | A1 * | 4/2005 | Hellmeier et al. | 101/40.1 |
| 2007/0039490 | A1 | 2/2007 | Aichele et al. | |

FOREIGN PATENT DOCUMENTS

| | | | |
|---|---|---|---|
| EP | 1093912 | A1 | 4/2001 |
| EP | 1468827 | A1 | 10/2004 |
| EP | 1491336 | A1 | 12/2004 |
| EP | 1525980 | A1 | 4/2005 |
| EP | 174603 | A1 | 2/2007 |
| FR | 2782376 | | 2/2000 |
| JP | 56144993 | | 11/1981 |

* cited by examiner

*Primary Examiner* — Leslie J Evanisko
(74) *Attorney, Agent, or Firm* — Browdy and Neimark, PLLC

(57) ABSTRACT

A printing machine for cylindrical objects, comprising a carousel for moving for locating the cylindrical objects in a successive number of work stations, among which at least a printing station and a drying station; at least a device for inking for printing on the lateral surface of a cylindrical object located in the printing station; and at least a drying device for generating a beam of rays which strike a cylindrical object located in the drying station; the drying device including an obturator for intercepting the beam of rays when the means for moving transfer the objects from one station to another.

13 Claims, 4 Drawing Sheets

PRINTING MACHINE AND DRYING DEVICE FOR CYLINDRICAL OBJECTS

TECHNICAL FIELD

The invention relates in general to a printing machine, and more particularly to a printing machine for cylindrical objects.

BACKGROUND ART

Generally, known printing machines comprise a rotatable carousel provided with a circumferential series of angularly-equidistanced chucks, each of which bears a single object to be printed upon.

The carousel rotates discontinuously at a constant angular step which is equal to the circumferential step separating the chucks.

In this way, each single chuck is located in a succession of work stations, to among which is one or more printing stations.

An inking means operates at each printing station, which can be a silk screen, a roller or another known means in the sector.

The inking means is located above the rotation plane of the chucks, and moves to release ink onto the lateral surface of the cylindrical object which, contemporaneously, rotates about itself, being activated by the chuck.

Once the inking stage has been completed, the cylindrical object is moved into a further work station, a drying station, where it is subjected to the action of a drying device, typically a lamp, for example an ultra-violet lamp, which dries the ink on the object, thus preventing running and imperfections in the design.

A requirement of this type of printing machine is that the inker should never be subjected to the action of the drying device.

Any such drying action would lead to drying up the ink on the inker itself, rendering further printing impossible.

For this reason, the drying device is generally located by a side of the inker means, and is oriented towards the cylindrical object located in the drying station.

A drawback of this arrangement is that the printing stations and drying stations must be separated by a rather wide gap in order to prevent the inker means being dried together with the object.

The gap, substantially unused, corresponds to a linear step separating the chucks of the rotatable carousel; the step in turn fixes the ratio between the number of chucks and the overall diameter of the carousel.

It follows that if the number of chucks is to be increased, and therefore the number of work stations, the overall size of the printing machine must also be proportionally increased.

As can be imagined, this is a very considerable drawback when, for reasons connected with the process, printing machines with many work stations and many chucks are to be realised.

The aim of the present invention is to obviate the above-mentioned drawback in the prior art, while at the same time guaranteeing that the silk screens are never subjected to the heat issued by the drying devices.

A further aim of the invention is to reach the above-mentioned objective by providing a simple, rational and economical solution.

The aims are attained by the invention in which a printing machine for cylindrical objects includes carousel means for moving for locating the cylindrical objects in a successive number of work stations, among which at least a printing station and at least a drying station, at least a means for inking for printing on the lateral surface of a cylindrical object located in the printing station, and at least a drying device for generating a beam of rays which strike a cylindrical object located in the drying station, wherein the drying device comprises an obturator for intercepting the beam of rays when the means for moving transfer the objects from one station to another.

Other particularly advantageous preferred embodiments, related to a silk screening machine, in which the drying device comprises a shield system for directing the rays only onto the cylindrical object located in the drying station. According to one embodiment, the drying station and the printing station are a single station. The drying device comprises a source of rays, and an upper screen provided with a slit, the slit screening the rays emitted by the source and delimiting the beam of rays. The slit is elongate and is arranged parallel to and vertically aligned with and below the cylindrical object located in the drying station. The slit is not longer than a longest cylindrical object processable by the machine. The slit is narrower than or equal in width to a diameter of a slimmest cylindrical object processable by the machine. The light source is a lamp according to one embodiment. The lamp is elongate and is arranged parallel to the slit. The machine further comprises an obturator for selectively closing the slit, the obturator comprising a cylindrical body arranged parallel with respect to the slit and having a diameter which is larger than a breadth of the slit, the cylindrical body exhibiting a diametral longitudinal slit which collimates with the slit. The cylindrical body is associated to actuator means which selectively place the longitudinal slit in an open position, in which the longitudinal slit collimates with the slit, and in a closed position, in which the longitudinal slit is angularly displaced with respect to the slit. The machine further comprises a detecting device of the position of the obturator. The detecting device comprises a mobile body, solidly fixed to the obturator, and a fixed proximity sensor for detecting a position of the mobile body. The upper screen is associated to means for cooling. The means for moving comprise a rotatable carousel provided with a circumferential series of chucks, each of which chucks can bear a cylindrical object.

BRIEF DESCRIPTION OF THE DRAWINGS

Further characteristics and advantages of the invention will emerge from a reading of the following description, provided by way of non-limiting example, with the aid of the figures of the accompanying drawings, in which:

BEST MODE FOR CARRYING OUT THE INVENTION is FIG. 1 illustrates a silk screening machine 1 for printing on a lateral surface of cylindrical objects 100.

Figure 1:
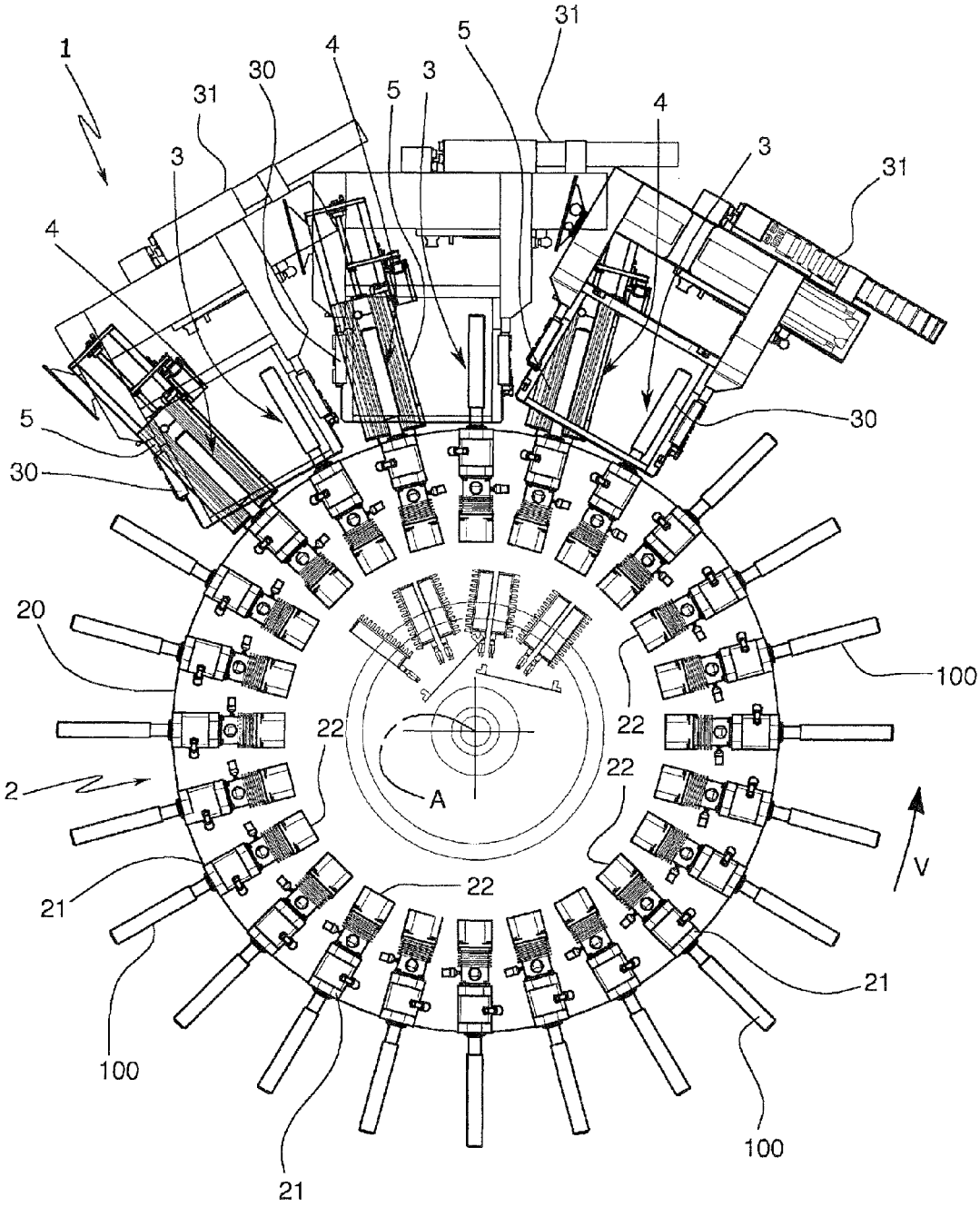
FIG. 1 is a plan view of a silk-screening machine, in which some components have been removed better to evidence the characteristics of the invention.

The machine 1 comprises means for moving, denoted in their entirety by 2, which locate each object 100 in a succession of predetermined work stations, at which the object 100 is subjected to various stages of the printing process. In the illustrated example, the means for moving 2 comprise a rotatable carousel 20 provided with a circumferential series of chucks 21, which are arranged spoke-fashion and are angularly equidistanced one from another.

Each chuck 21 coaxially bears a single object 100, and is provided with a respective motor 22 by means of which it can rotate the object 100 about an axis thereof.

The rotatable carousel 20 is associated to a motor which is of known type, which motor sets the carousel 20 in rotation about a central vertical axis A thereof, in a predetermined rotation direction V.

The rotation is discontinuous, with a constant angular step equal to a distance between the chucks 21, in order that each single object 100 is stopped in the above-mentioned succession of prefixed work stations.

In the example of FIG. 1, the rotatable carousel 20 locates the objects 100 in three distinct operative printing stations 3, where the lateral surface of the objects 100 is subjected to a same number of printing stages using a silk-screening process.

Note that the number and relative positions of the printing stations 3 are provided purely by way of example, and can vary according to the specific process for which the machine 1 is destined.

A small flat silk screen 30 operates in each printing station 3.

The screen 30 is arranged parallel to the moving direction of the chucks 21, higher than the chucks 21, and is positioned vertically above the object 100 located in the relative printing station 3.

Actuator means 31 are associated to the screen 30, which actuators 31 move the screen 30 in a lie plane thereof, with alternating motion, in a perpendicular direction to the axis of the object 100.

In this way, the linear displacement of the screen 30 together with the contemporaneous and coordinated rotation of the chuck 21 enable ink to be released onto the lateral surface of the object 100, realising thereon a predetermined design.

The functioning of the screen in the printing station 3, like that of the accessory organs which operate in the printing station 3 itself, are of known type and are not further described herein.

It is, on the other hand, very important to stress that the screen 30, moving alternatingly, displaces cyclically between two distinct limit positions.

In the following description, these limit positions are respectively called advanced and retracted, with reference to the advancement direction V of the chucks 21 on the rotatable carousel 20.

In particular, the screens 30 shown in FIG. 1 are all in the advanced position.

As shown in FIG. 1, after each printing station 3, the objects 100 are located by the rotatable carousel 20 in a subsequent drying station 4.

A drying device, denoted in its entirety by 5, operates in each drying station 4, which drying device 5 dries the ink on the object 100 previously printed upon, in order to prevent running and imperfections in the design.

The drying device 5 is located lower than the movement plane of the chuck 21, and is vertically aligned below the object 100 located in the drying station 4 (see FIG. 3).

Thanks to this arrangement, the drying device 5 is at a lower height than the screen 30 which operates in the preceding printing station 3, and thus does not interfere with the linear movement thereof.

For this reason, the space separating the printing stations 3 and the drying is stations 4 is very small, and the screen 30, each time it is in the advanced position (see FIG. 1), is above the drying device 5.

Figure 3:
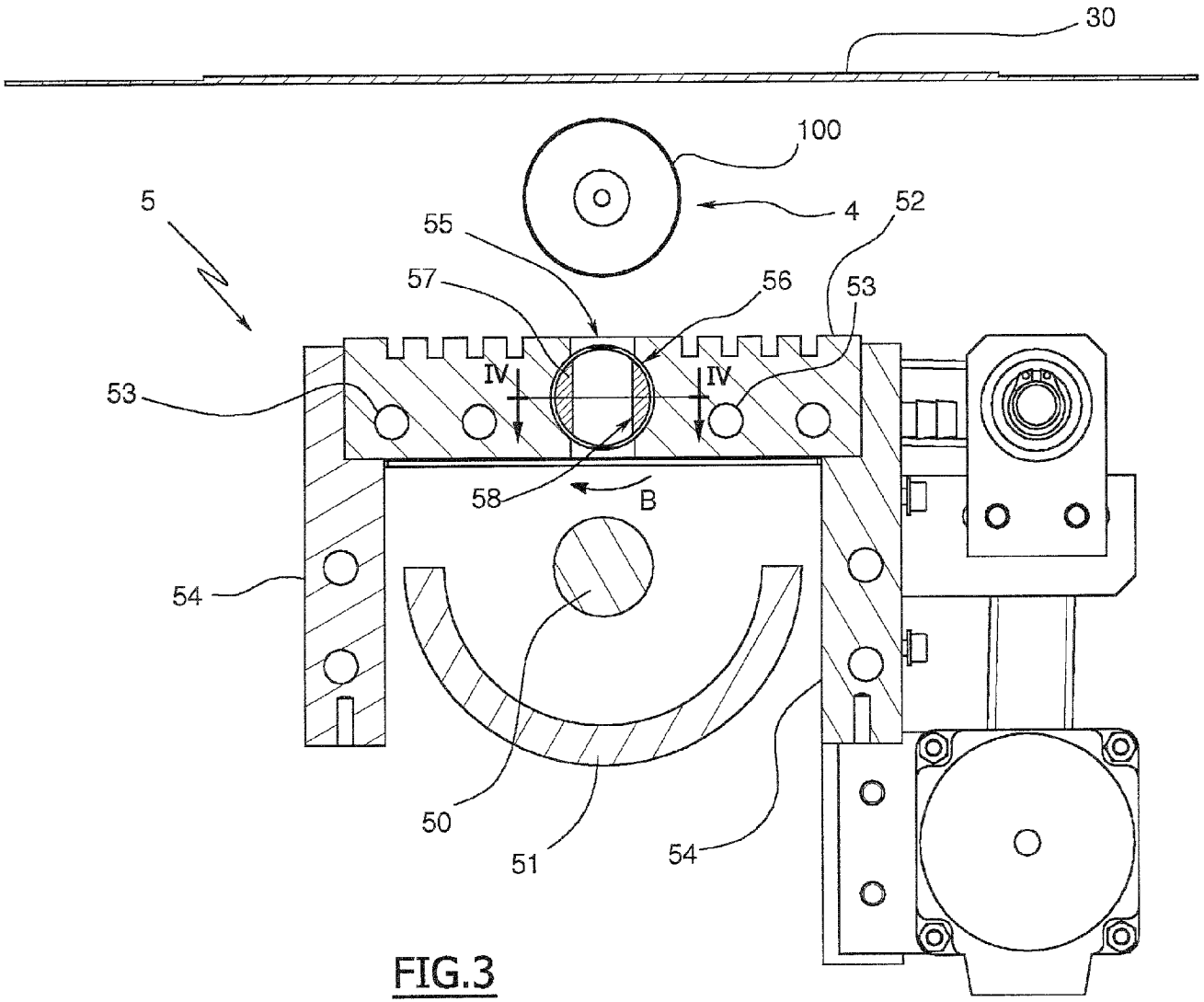
FIG. 3 is a section along line III-III of FIG. 2.

As shown in FIG. 3, the drying device 5 comprises a lamp 50, for example an ultra-violet lamp.

Figure 4:
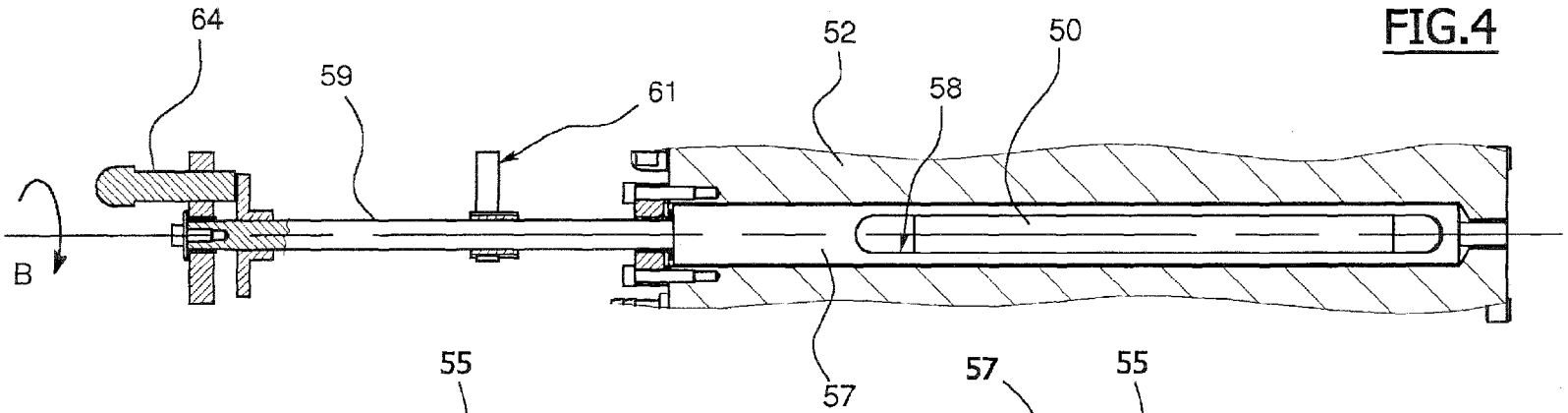
FIG. 4 is a plan view of the drying device of FIG. 2.

The lamp 50 exhibits an elongate shape, in the example cylindrical, and is arranged in such a way as to be parallel and vertically aligned with the cylindrical object 100 located in the relative drying station 4 (see also FIG. 4).

Below the lamp 50 is a reflecting screen 51, an arched shape of which enables the rays emitted by the lamp 50 to be deflected upwards.

An upper screen 52 is interpositioned between the lamp 50 and the object 100, which upper screen 52 is usually made of opaque material and is generally flat.

A series of longitudinal channels 53 run through the upper screen 52, in which refrigerating liquid is injected. The screen 52 is supported by two lateral flanks 54 which develop in a downwards direction.

Figure 2:
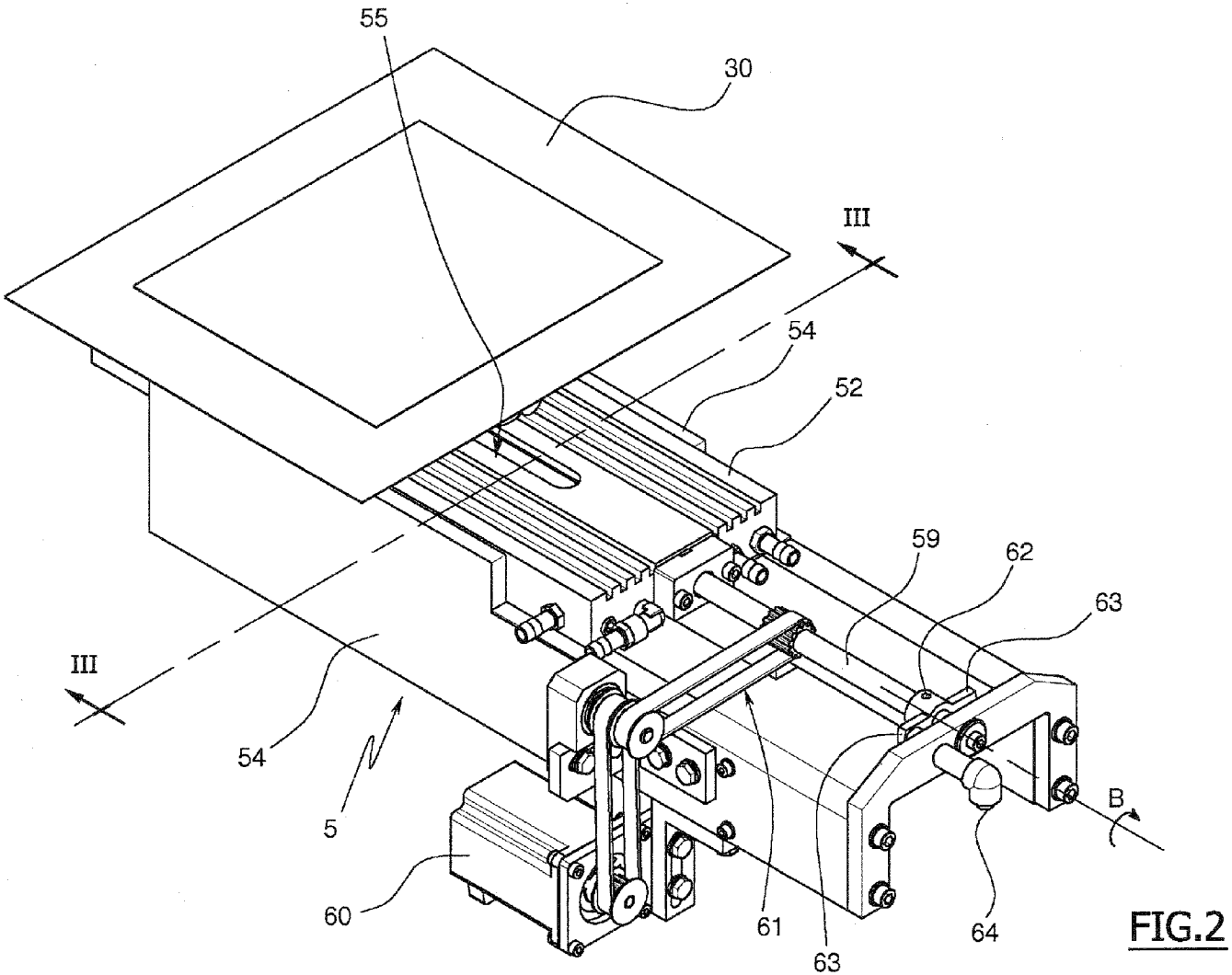
FIG. 2 is a perspective view of the drying device of the machine of FIG. 1.

FIG. 2 shows how the reflecting screen 51, the upper screen 52 and the lateral flanks 54 define overall a box structure cover which closes around and internally conceals the lamp 50.

The upper screen 52 is provided with a longitudinally-developing central slit 55, which is arranged parallel to and vertically aligned with the lamp 50, in order to allow the UV rays to pass through.

In this way a concentrated beam of rays is generated, oriented upwards, which illuminates and dries the object 100 located in the overlying drying station 4 by irradiation.

It is stressed that the term "beams of rays" relates also to radiations in the visible field, as well as to any radiations able to heat the object 100, for is example rays in the infrared range.

The slit 55 is of about the same length as, and in any case is not longer than, the longest of the objects 100 which can be processed by the machine.

Further, as illustrated in FIG. 3, the slit 55 is narrower than the diameter of the slimmest of the objects 100 which can be processed by the machine.

In this way, the dimensions of the beam of rays filtering from the slit 55 are such as to strike only the object 100 located in the drying station 4, and nothing else which is located in the vicinity.

The transversal section of the slit 55 exhibits two facing recesses which define a longitudinal seating 56 for receiving an obturator 57.

In the illustrated example, the obturator 57 is a cylindrical body, arranged parallel to the slit 55 and having a larger diameter than the width of the slit 55.

The cylindrical body 57 couples to the longitudinal seating 56 in order to be vertically aligned to the slit 55 and to be free to rotate about a central axis of the cylindrical body 57 itself.

In particular, the cylindrical body 57 is crossed by a diametral through-slit 58 having a longitudinal development; the through-slit 58 is located exactly at the tract of the cylindrical body 57 vertically aligned with the slit 55, and thus with the object 100 in the drying station 4.

As illustrated in FIGS. 2 and 4, the cylindrical body 57 is rigidly connected to a coaxial shaft 59, which projects from the body of the upper screen 52 and is connected to an activating motor 60 by means of a belt transmission 61.

The activating motor 60 engages the cylindrical body 57 to rotate about the central axis thereof in a predetermined rotation direction B.

In particular the activating motor 60 causes the cylindrical body 57 to perform rotations limited to 90°, in order that it is brought alternatively into an open position and into a closed position of the slit 55.

Figure 5B:
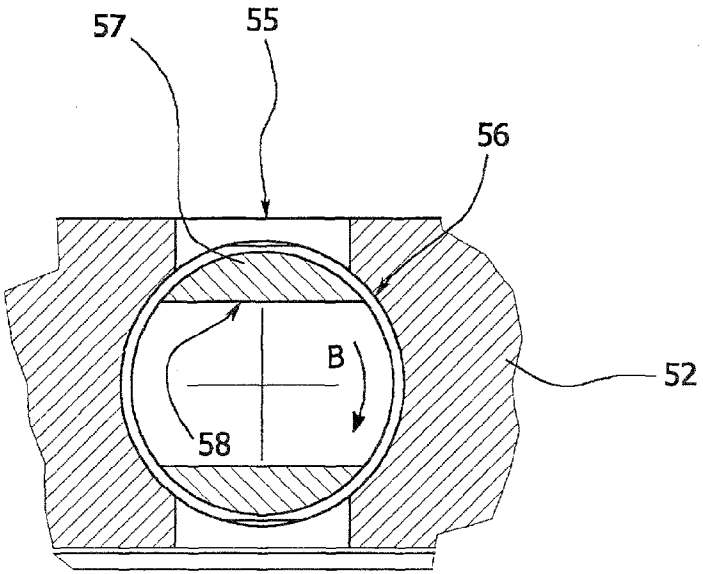
FIGS. 5*a* and 5*b* are the section along line V-V denoted in FIG. 3, shown during two operating stages of the drying device.
Figure 5A:
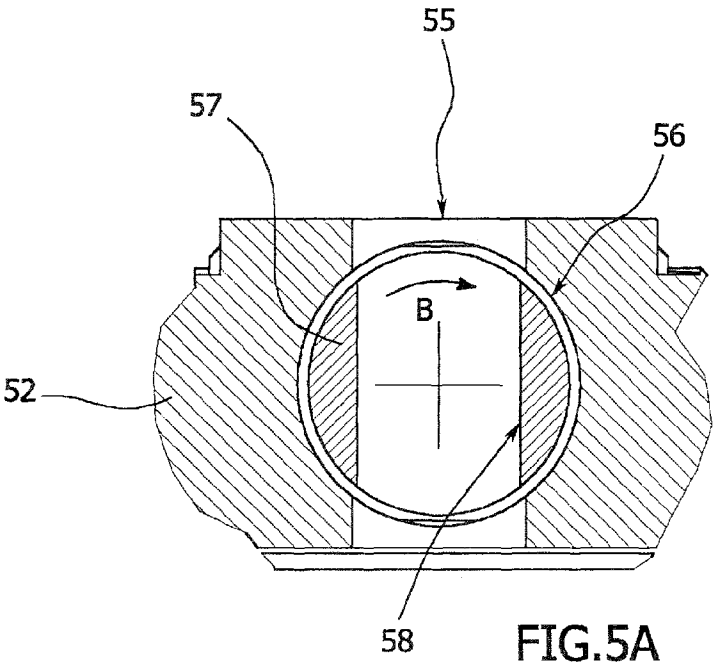

In the open position, the through-slit 58 of the cylindrical body 57 is perfectly facing the slit 55, so that the beam of rays emitted by the lamp 50 can filter and dry the cylindrical body 100 located in the drying station 4 (see FIG. 5*a*).

In the closed position, the through-slit 58 is facing the body of the upper screen 52 and the slit 55 is therefore closed off by the cylindrical body 57 which prevents the rays from filtering (see FIG. 5*b*).

A hub 62 is keyed on the free tract of the support shaft 59, which hub 62 is provided with two projecting tabs 63, which are positioned on diametrically opposite sides with respect to the support shaft 59.

The projecting tabs 63 cooperate with a proximity sensor 64 fixed and located in an eccentric position with respect to the support shaft 59.

In particular, the projecting tabs 63 are in proximity of the sensor 64 when the cylindrical body 57 is in the open position, while they are distanced therefrom when the cylindrical body 57 is in the closed position (see FIG. 4).

In this way, the proximity sensor 67 constantly detects the position of the cylindrical body 57 and communicates the position to a logic control unit (not illustrated) which can, for example, arrest the machine if the position detected does not coincide with the position required for correct machine functioning. The machine 1 function is described herein below. Note that the present description is set out with reference to only one printing station 3 and a successive drying station 4. All other printing stations 3 and drying stations 4 function in the same way.

Following a rotation of the rotating carousel 20, a first cylindrical object 100 is located in the printing station 3, and a second cylindrical object 100, previously printed, is located in the drying station 4.

The silk screen 30 is in the advanced position thereof, partially superposed on the drying device 5, as shown in FIG. 1.

The obturator 57 of the drying device 5 is in the open position to enable the rays coming from the lamp 50 to dry the ink on the second cylindrical object 100, which rotates contemporaneously on itself, activated by the chuck 21.

During this stage, the second cylindrical object 100 functions and a protective shield for the silk screen 30, which is not struck by the beam of rays issuing from the drying device 5.

This is due to the dimensions of the beam of rays defined by the corresponding dimensions of the slit 55 of the upper screen 52.

In the meantime, the silk screen 30 performs the printing operation on the first object 100 located in the printing station 3, displacing from the advanced position to the retracted position, and returning, finally, to the advanced position.

At this point, the carousel 20 rotates by a step to bring the first object 100 into the drying station 4, and to bring a new object 100 into the printing station 3.

During this rotation, the second object 100 is no longer interposed between the drying device 5 and the silk screen 30, and the beam of rays generated by the lamp 50 might illuminate and dry the silk screen 30, causing the ink internally thereof to dry.

In order to prevent this from happening, before the carousel 20 begins to rotate, the obturator 57 is brought into the closed position, in order to prevent the rays of the lamp 50 from filtering from the slit 55 of the upper screen 52 and illuminating the silk screen 30.

Finally, when the first object 100 reaches the drying station 4, the obturator 57 returns into the open position and the cycle is repeated.

The described example relates, as mentioned, to a machine for silk-screen printing.

The invention is equally applicable to a machine in which the inking means is a roller lying in a plane below the movement plane of the chucks.

In this case, the drying device can be located above the plane, in an opposite position to the chuck, which is in the printing station, thus causing the printing station and the drying station to coincide.

In this position, during the printing stage, the obturator is open and the inker is protected from the action of the rays by the object itself during the printing process.

During the movement of the object, the obturator closes.

The synchronising between the rotations of the chucks 21, the rotations of the obturators 57 and the movement of the silk screen 30 can be advantageously obtained by a control architecture, of known type, comprising a single "master clock" which synchronises the control cards of the axes involved.

The invention claimed is:

1. A printing machine for cylindrical objects (100), comprising:

carousel means (2) for moving for locating the cylindrical objects (100) each in a successive number of work stations, among which at least a printing station (3) and at least a drying station (4);

at least a means for inking (30) for printing on the lateral surface of a cylindrical object (100) located in the printing station (3); and at least a drying device (5) for generating a beam of rays which strike a cylindrical object (100) located in the drying station (4);

said printing stations (3) and said drying stations (4) being at least set in partially opposite positions, wherein said drying device (5) comprises a source (50) of rays, an upper screen (52) provided with a slit (55), and an obturator (57) for intercepting the beam of rays and for selectively closing the slit (55), the slit (55) screening the rays emitted by the source (50) and delimiting the beam of rays, and where said obturator (57) is associated with actuating means (59, 60, 61) apt to operate said obturator (57) selectively in cooperation with said carousel means (2) in order to protect said means for inking (30) and comprises a cylindrical body (57) arranged parallel with respect to the slit (55) and having a diameter which is larger than a breadth of the slit (55), the cylindrical body (57) exhibiting a diametral longitudinal slit (59) which collimates with the slit (55).

2. The machine of claim 1, wherein the drying device (5) comprises a shield system for directing the rays only onto the cylindrical object (100) located in the drying station (4).

3. The machine of claim 1, wherein the drying station (4) and the printing station (5) are set in opposite positions.

4. The machine of claim 1, wherein the slit (55) is elongate and is arranged parallel to and vertically aligned with and below the cylindrical object (100) located in the drying station (4).

5. The machine of claim 4, wherein the slit (55) is not longer than a longest cylindrical object (100) processable by the machine.

6. The machine of claim 5, wherein the slit (55) is narrower than or equal in width to a diameter of a slimmest cylindrical object (100) processable by the machine.

7. The machine of claim 1, wherein the source (50) of rays is a lamp.

8. The machine of claim 7, wherein the lamp (50) is elongate and is arranged parallel to the slit (55).

9. The machine of claim 1, wherein the cylindrical body (57) is associated to actuator means (59, 60, 61) which selectively place the longitudinal slit (58) in an open position, in which the longitudinal slit (58) collimates with the slit (55), and in a closed position, in which the longitudinal slit (58) is angularly displaced with respect to the slit (55).

10. The machine of claim 1, further comprising a detecting device (62, 64) of the position of the obturator (57).

11. The machine of claim 10, wherein the detecting device comprises a mobile body (62), solidly fixed to the obturator (57), and a fixed proximity sensor (64) for detecting a position of the mobile body (62).

12. The machine of claim 1, wherein the upper screen (52) is associated to means for cooling (53).

13. The machine of claim 1, wherein the carousel means for moving (2) comprise a rotatable carousel (20) provided with a circumferential series of chucks (21), each of which chucks (21) can bear a cylindrical object (100).

* * * * *